US005735195A

United States Patent [19]

Hewitt et al.

[11] Patent Number: 5,735,195

[45] Date of Patent: Apr. 7, 1998

[54] COTTON MODULE BUILDER ASSEMBLY

[75] Inventors: Geoffrey John Hewitt, Dalby; John Edward Hewitt, Macalister, both of Australia

[73] Assignee: G. T. Enterprises Pty Ltd, Queensland, Australia

[21] Appl. No.: 681,816

[22] Filed: Jul. 29, 1996

[30] Foreign Application Priority Data

Jul. 31, 1995 [AU] Australia ..... PN4465

[51] Int. Cl.[6] ..... B30B 3/02

[52] U.S. Cl. ..... 100/65; 100/210

[58] Field of Search ..... 100/65, 67, 68, 100/210

[56] References Cited

U.S. PATENT DOCUMENTS

| | | | |
|---|---|---|---|
| 3,749,003 | 7/1973 | Wilkes et al. . | |
| 3,941,047 | 3/1976 | Orlando et al. . | |
| 4,060,028 | 11/1977 | Luscombe | 100/210 |
| 4,426,925 | 1/1984 | Bergmann | 100/65 |
| 5,361,561 | 11/1994 | Porter . | |

FOREIGN PATENT DOCUMENTS

| | | | |
|---|---|---|---|
| 934984 | 6/1982 | U.S.S.R. | 100/210 |
| 1590418 | 9/1990 | U.S.S.R. | 100/210 |
| 87/04409 | 7/1987 | WIPO | 100/65 |

*Primary Examiner*—Stephen F. Gerrity
*Attorney, Agent, or Firm*—Sidley & Austin

[57] ABSTRACT

A cotton module builder incorporates a roller that continuously applies variable pressure to a cotton module during building, thereby building the cotton module faster than conventional cotton module builders. The roller incorporates a number of vanes which pin the cotton fibers to aid in compaction of the module. The roller may take different shapes but a generally cylindrical shape is preferred.

25 Claims, 3 Drawing Sheets

COTTON MODULE BUILDER ASSEMBLY

TECHNICAL FIELD OF THE INVENTION

This invention relates to a cotton module builder and in particular a cotton module builder having a roller for compacting cotton to thereby increase the speed of cotton module production.

BACKGROUND OF THE INVENTION

A cotton module builder is a movable bin with an open top and open bottom into which picked cotton is deposited for compacting into a cotton module. Typically, cotton is picked using a mechanical cotton harvester and loaded into on site trailers or wagons. The trailers or wagons then transport the cotton to the on site cotton module builder. The cotton module builder compresses the cotton into a firm, self supporting, box-like stack or module having dimensions of approximately 10 meters long by 3 meters high by 2.5 meters wide.

An early cotton module builder was disclosed in U.S. Pat. No. 3,749,003 in the name of Wilkes et al. Cotton module builders have changed little since the grant of U.S. Pat. No. 3,749,003 and they generally comprise a bin with an open top and open bottom. A rear end wall of the bin is hinged to allow the wall to open and when a complete cotton module has been formed the rear end wall is opened and the cotton module builder is rolled forward to leave the cotton module behind.

A carriage member is disposed between longitudinal sides of the bin and is movable along the bin from one end to the other. Mounted to the carriage is a reciprocating tamper which is hydraulically operated to compact cotton in the bin. A number of minor improvements have been made to cotton module builders, for example, U.S. Pat. No. 3,941,047 discloses an improved side frame structure to increase the structural rigidity of the module builder.

Another minor improvement is described in U.S. Pat. No. 5,361,561 which is directed to a conventional cotton module builder in combination with an apparatus for rolling a cover over the cotton module while the cotton module is within the cotton module builder or as the cotton module builder is being moved from the cotton module. The apparatus for rolling out the cover is attached to the carriage member and arranged so that the cover is rolled out as the carriage moves from one end of the module to the other.

Unfortunately, the known cotton module builders all have a reciprocating tamper which is relatively inefficient because its stroke cycle limits the speed of compacting the cotton. While cotton module builders have remained relatively unchanged, cotton harvesting techniques have developed. Modern harvesters are able to harvest cotton today at a much greater rate than in the past. This has meant that the cotton module builder has become a bottle neck in the harvesting process. The problem could be overcome by using multiple cotton module builders but the cost of cotton module builders precludes this option for most farmers. Hence, due to the recent improvements in cotton harvesting techniques, current cotton module builders need to be able to operate at higher speeds.

OBJECT OF THE INVENTION

It is an object of the invention to provide a cotton module builder which overcomes or at least alleviates at least one of the problems associated with prior art cotton module builders.

SUMMARY OF THE INVENTION

Accordingly, to one aspect of the invention there is provided a cotton module builder including:

an open top bin having two spaced side walls and two spaced end walls, at least one of said walls being a door wall movable from a closed position to an open position;

a carriage movably mounted to the bin to thereby move along the length of one of the walls; and a roller rotatably mounted to the carriage along an axis lateral to the direction of movement of the carriage, wherein, the roller is adapted to apply continuous pressure to a cotton module being formed in the bin during movement of the carriage.

Preferably, there is an actuation means operatively coupled to said roller to provide rotational movement thereof about the axis.

Preferably, the actuation means is fluid actuated. However, the actuation means may be electrically actuated.

Suitably, the actuation means is hydraulically actuated or alternatively it may be pneumatically actuated.

The carriage may be operatively coupled to a further actuation means for providing movement along the length of one of the walls.

The further actuation means may be fluid actuated or otherwise.

Preferably, the further actuation means is hydraulically actuated or alternatively it may be pneumatically actuated.

Suitably, the speed of rotation of the roller is matched to a speed of movement of the carriage along the length of said one of said side walls.

The roller may suitably be generally cylindrical shaped.

Suitably, the roller includes longitudinally extending vanes. The vanes preferably are shaped and positioned to allow compaction of the cotton in corners of the bin.

The vanes may extend for the length of the roller or may be disposed at the longitudinal ends thereof.

Preferably, the carriage is mounted to move along the length of the side walls.

Suitably, the slide walls taper away from the open top of the bin towards an open bottom of the bin.

Preferably, there is a height adjustment means operatively coupled to the roller for varying the height of the roller relative to the bin.

The height adjustment means is preferably a fluid actuated height adjustment ram.

Suitably, the height adjustment ram may be hydraulically actuated or alternatively pneumatically actuated.

Suitably, there are height adjustable wheels to allow for transportation of the assembly.

The assembly may be self-propelled or alternatively towable.

Preferably, there are door actuation means operatively coupled to the door wall to provide movement thereof from the closed position to the open position and vice versa.

In a further form, the invention resides in a roller assembly for a cotton module builder, the cotton module builder being of a type comprising an open top bin having two spaced side walls and two spaced end walls and a carriage movably mounted to the bin to thereby move along the length of one of said walls;

the roller assembly comprising a roller rotatably mounted to the carriage along an axis normal to the direction of movement of the carriage, wherein the roller applies continuous pressure to a cotton module being formed in the bin during movement of the carriage.

BRIEF DESCRIPTION OF DRAWINGS

In order that the invention will be readily understood and put into practical effect, reference will now be made to preferred embodiments in which.

DETAILED DESCRIPTION

Figure 1:
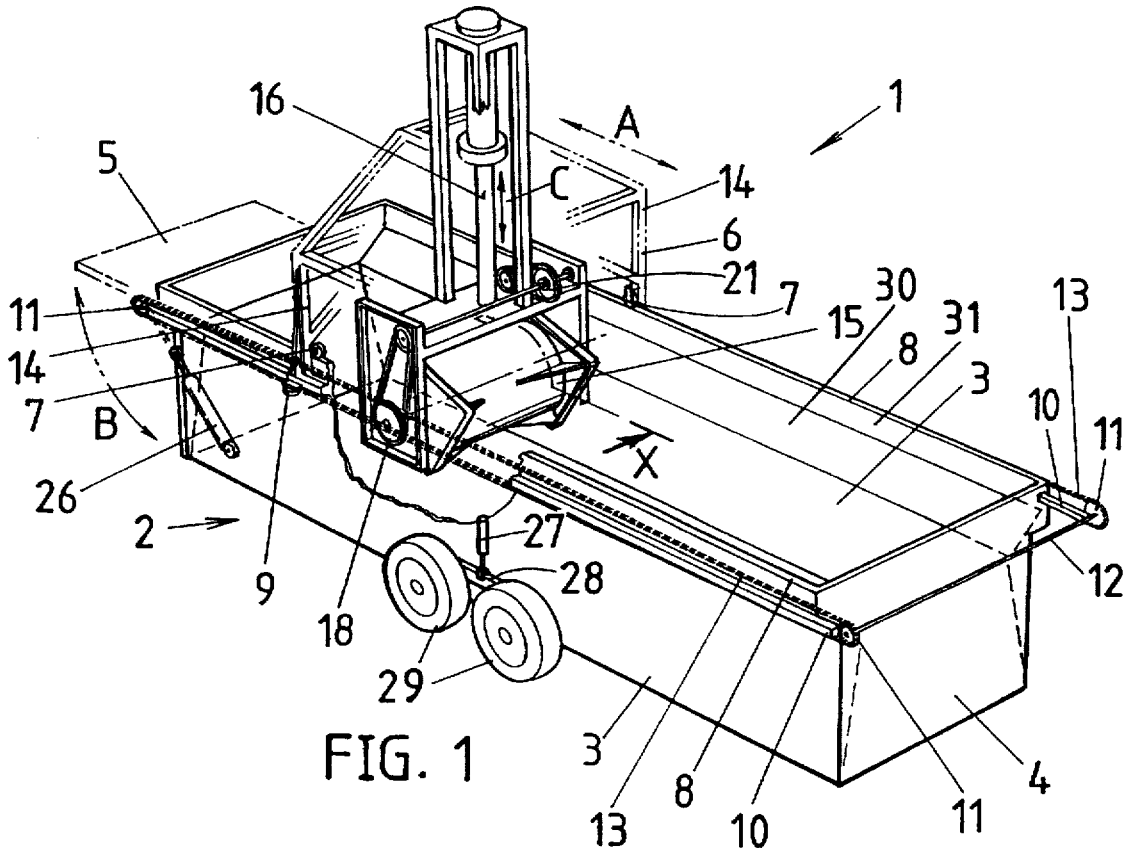
FIG. 1 is a perspective view of a cotton module builder according to the invention.

Referring to FIG. 1, there is illustrated a cotton module builder 1 having an open top and an open bottom bin 2 with two spaced and upright side walls 3 outwardly tapering away from the open top towards the open bottom. Bin 2 also has two spaced and upright end walls one of which is identified by numeral 4, the other one being a door wall 5 moveable (shown by arrows B) from a closed position to an open position (shown in phantom).

A carriage 6 is moveably mounted to bin 2 by rollers 7 engaging upper edges 8 of bin 2 and further rollers 9 engaging respective tracks 10 to prevent lateral movement of carriage 6. Hence, carriage 6 is moveable along the length of walls 3 in directions illustrated by arrows A. Also mounted to bin 2 are sprockets 11 two of which are operatively coupled by shaft 12 to a drive means such as a hydraulic motor (not shown).

Two continuous chains 13 extend along the length of respective side walls 3 and engage sprockets 11 located adjacent the respective ends of walls 3. Each one of chains 13 is attached to carriage 6 at a respective two of four upright carriage frame members 14. Rotatably mounted to carriage 6 about an axis of rotation lateral to the direction of movement of carriage 6 (shown by arrows A) is a roller 15. As illustrated, the axis of rotation is normal to the direction of movement of carriage 6 and roller 15 extends between inner surfaces of walls 3.

Figure 4:
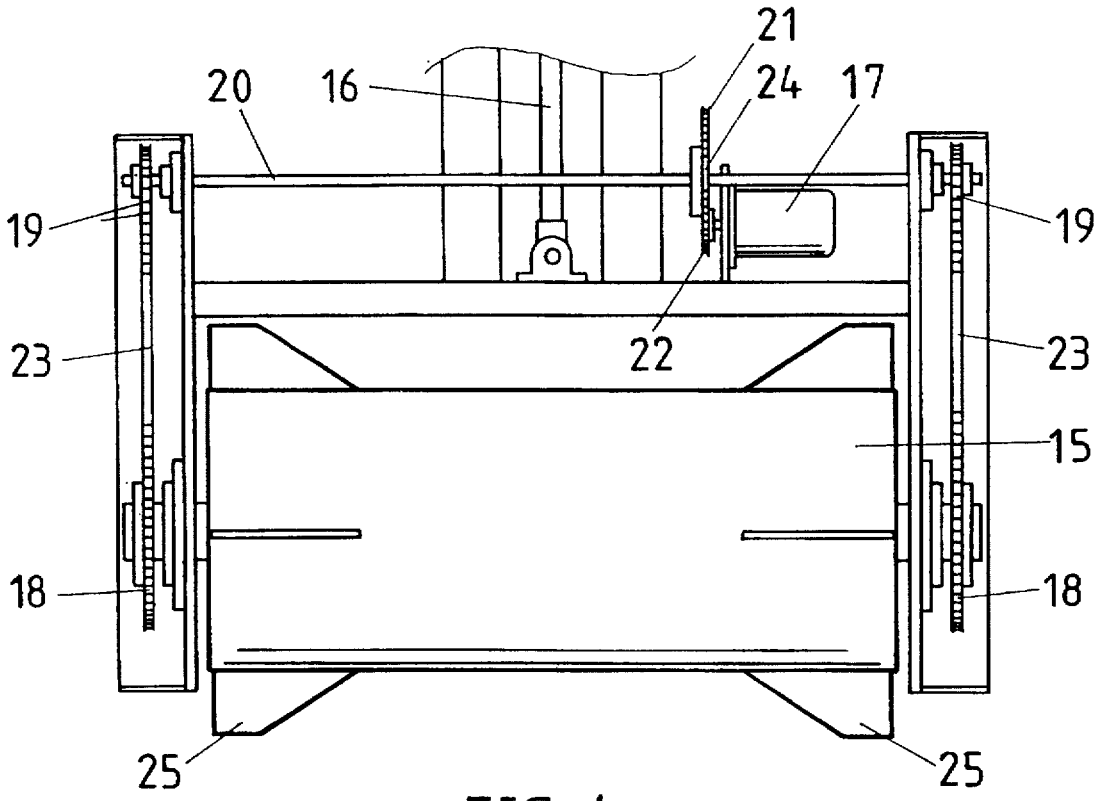
FIG. 4 is a front elevation view of part of the roller assembly of FIG. 1.

Referring to both FIGS. 1 and 4, carriage 6 includes a hydraulically actuated ram 16 to provide height adjustment (illustrated by arrows C) of roller 15 relative to bin 2. Roller 15 is operatively coupled to a hydraulic motor 17 by the assembly comprising sprockets 18, 19, shaft 20, sprockets 21, 22 and chains 23, 24. Furthermore, roller 15 has longitudinally extending vanes 25 shaped and positioned to allow compaction of cotton located in corners of bin 2.

A hydraulic ram 26 is pivotally mounted at one end to an outer side of one of walls 3, the other end of ram 26 is pivotally attached to door wall 5. When extended, ram 26 pushes door wall 5 to the open position and when detracted ram 26 closes door wall 5.

Two further hydraulic rams 27 (only one of which is shown) are mounted to a respective one of side walls 3, the arms of rams 27 are pivotally attached to respective cross members 28 to which wheels 29 are rotatably mounted.

Adjacent upper edges of both side walls 3 are chutes 30 for guiding cotton into bin 2 and at the top of bin 2 is a continuous ridge 31 for providing a storage area for cotton before compression.

Figure 2:
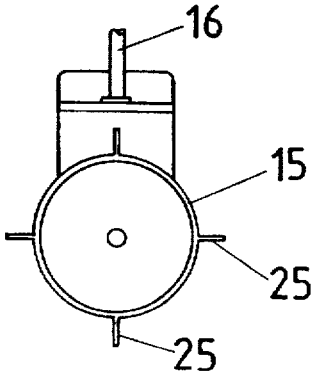
FIG. 2 is a cross sectional view through X—X of part of a roller assembly illustrated in FIG. 1.
Figure 3:
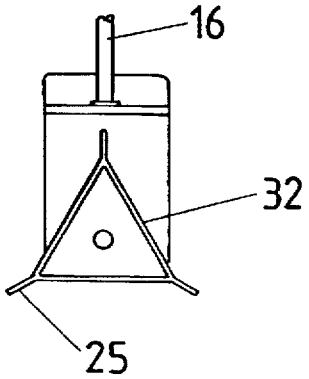
FIG. 3 is a cross sectional view of an alternative embodiment of a roller assembly.

Referring to FIG. 2 a cross sectional view of roller 15 is shown in which roller 15 is cylindrical and has four vanes, such as 25, at each end thereof. However, roller 15 may be other than cylindrical, for example, in FIG. 3 there is illustrated a triangular roller 32 having vanes 25 at each apex.

It will be appreciated that the triangular roller 32 provides a larger compaction surface for pressing the cotton than in the embodiment of FIG. 2.

Figure 5:
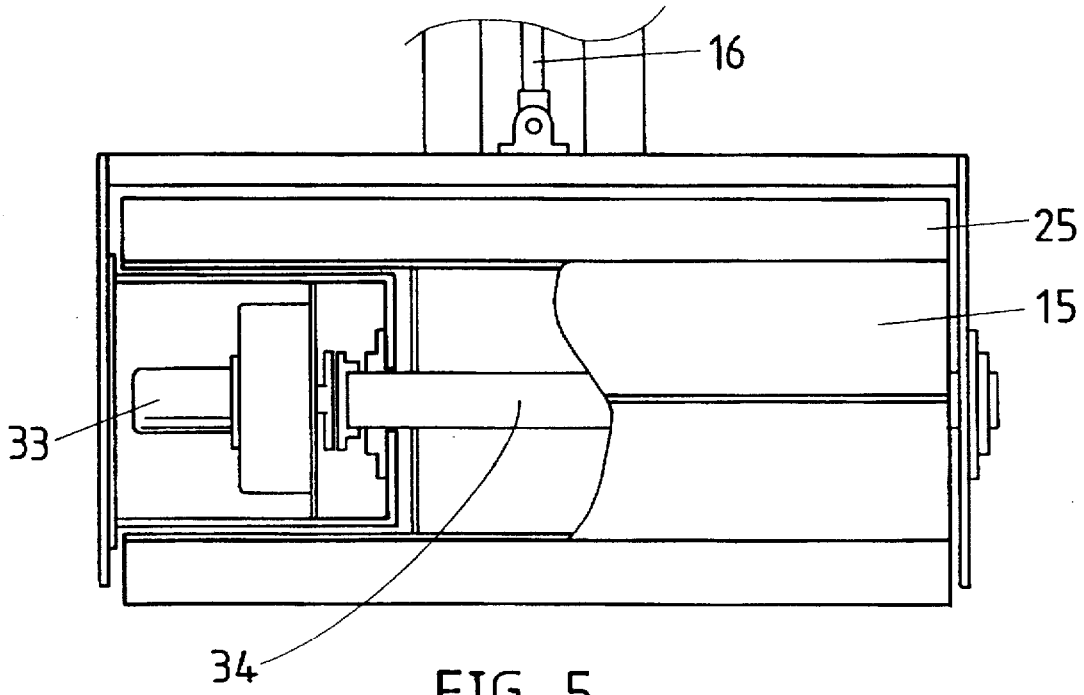
FIG. 5 is a front elevation view of an alternative embodiment of the roller assembly.

In FIG. 5 an alternative embodiment to FIG. 4 is illustrated in which a hydraulic motor 33 is located inside hollow cylindrical roller 15. Motor 33 is directly coupled to rotatable shaft 34 to which roller 15 is mounted, therefore there is no need for the sprockets, shaft and chains of FIG. 4. Also in FIG. 5, the vanes 35 are shown extending the full length of the roller 15.

Motor 17 or motor 33 is in hydraulic communication with the motor which drives shaft 12 and therefore the rotational speed of roller 15 can be matched to the speed of traverse of carriage 6 along the length of walls 3.

Figure 6:
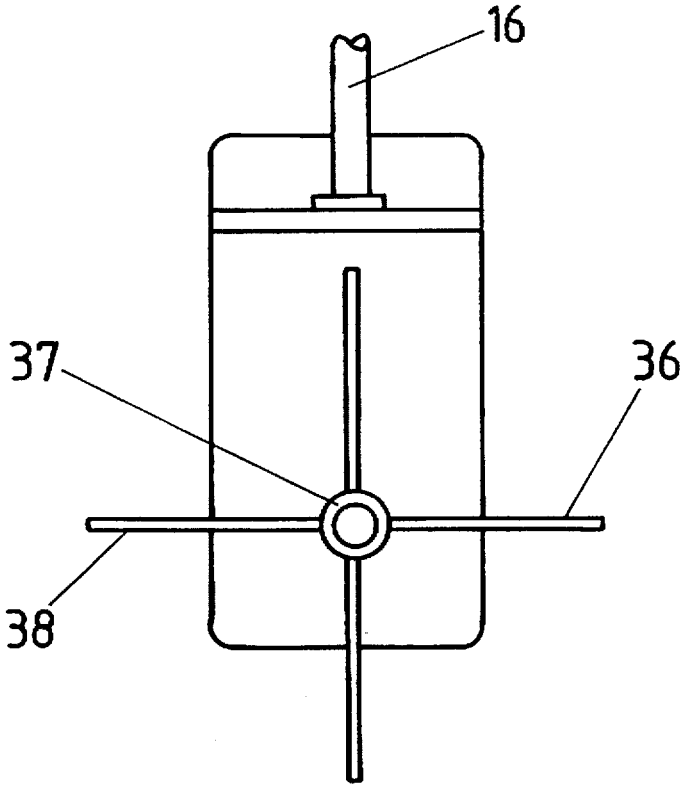
FIG. 6 is a further embodiment of a roller assembly.

A further alternate form of the roller is shown in FIG. 6. In this embodiment, the roller 36 comprises a shaft 37 with a number of vanes, such as 38. As with the embodiments described, above the height of the roller can be adjusted by hydraulically actuated ram 16.

The vanes 25, 35, 38 serve two purposes in compacting the cotton. Firstly, the vanes assist in compacting the cotton by pinning the cotton fibers into the already compacted cotton below. Secondly, the vanes are shaped to compress the cotton in the corners of the bin so as to form an evenly compressed module.

In use, door wall 5 is initially closed and locked by suitable locking means which are readily known to a skilled person. Cotton is then thrown into the open top of bin 2 and carriage 6 traverses along the length of walls 3 while roller 16 rotates thereby compressing the cotton against a ground surface. The height of roller 15 may be adjusted by ram 16 which has the additional function of varying the compacting pressure applied to the cotton in bin 2 (the pressure usually being anything up to 6 metric tonnes). When a cotton module has been formed, ram 26 opens door wall 5 and rams 27 raise bin 2 off the ground surface. When raised, bin 2 is solely supported from the ground surface by wheels 29 and due to the outwardly tapering side walls 3 the formed cotton module will remain on the ground surface. Cotton module builder 1 can then be towed away allowing the formed cotton module to pass under open wall 5, after which another cotton module can be formed by the cotton module builder 1.

If required, a pallet can be position under bin 2 so that the formed cotton module is supported from the ground surface by the pallet to thereby remove the possibility of dirt or water contacting the cotton module.

The invention provides for continuous pressure to be applied by roller 15 during compression of cotton in bin 2. This therefore increases the speed of cotton module production when compared with prior art cotton module builders which use reciprocating tampers.

Although the invention has been described with reference to preferred embodiments, it is to be understood that the invention is not limited to the specific embodiments described herein.

What is claimed is:

1. A cotton module builder, comprising:

an open top bin having two spaced side walls and two spaced end walls, at least one of said walls being a door wall movable from a closed position to an open position;

a carriage movably mounted to said bin to thereby move along a length of one of said side walls;

a pressure member rotably mounted to said carriage along an axis lateral to a direction of movement of said that said carriage, so pressure member rotates during movement of said carriage; and a drive mechanism operatively coupled to said rotating pressure member for lifting said pressure member, and for applying different downward pressures to said pressure member to compact the cotton with different pressures, wherein said pressure member and said drive mechanism in combination can apply different compressive pressures to a cotton module being formed in said bin during movement of said carriage.

2. The cotton module builder of claim 1 wherein said pressure member comprises a roller that includes longitudinally extending vans.

3. The cotton module builder of claim 2 wherein said vanes extend the length of said roller.

4. The cotton module builder of claim 2 wherein the roller and vanes act in combination to apply greater compression to the perimeter of the module, thereby forming a module with a convex top.

5. The cotton module builder of claim 1 wherein said pressure member comprises a roller that is of a generally cylindrical shape.

6. The cotton module builder of claim 1 further comprising an actuation means operatively coupled to said pressure member to provide rotational movement thereof about said axis.

7. The cotton module builder of claim 6 wherein said pressure member comprises a roller that is hollow and said actuation means is located within said hollow roller.

8. The cotton module builder of claim 6 wherein said actuation means is fluid actuated.

9. The cotton module builder of claim 8 wherein said actuation means is hydraulically actuated.

10. The cotton module builder of claim 1 further comprising a further actuation means operatively coupled to said carriage for providing movement of said carriage along the length of said one of said walls.

11. The cotton module builder of claim 10 wherein said further actuation means is fluid actuated.

12. The cotton module builder of claim 11 wherein said further actuation means is hydraulically actuated.

13. The cotton module builder of claim 1 wherein a speed of rotation of said pressure member is matched to a speed of movement of said carriage along the length of said one of said walls.

14. The cotton module builder of claim 1 wherein said drive mechanism is a fluid actuated height adjustment ram.

15. The cotton module builder of claim 14 wherein said drive mechanism ram is hydraulically actuated.

16. The cotton module builder of claim 1 wherein said rotating pressure member applies a continuous compressive pressure to said cotton module as said pressure member moves via said carriage along the length of said side wall.

17. A roller assembly for use with a cotton module builder, said module builder being of the type comprising:

an open top bin having two spaced side walls and two spaced end walls and a carriage movably mounted to said bin to thereby move along a length of one of said walls;

the roller assembly comprising a roller rotatably mounted to said carriage along an axis normal to a direction of movement of said carriage; and a drive mechanism operatively coupled to said roller for lifting said roller, and for applying different downward pressure to said roller to compact the cotton with different pressure;

wherein said roller and said height adjustment means drive mechanism in combination can apply different compressive pressures to a cotton module being formed in said bin during movement of said carriage.

18. The roller assembly of claim 17 wherein said roller comprises longitudinally extended vanes.

19. The roller assembly of claim 17 wherein said roller comprises a plurality of sets of longitudinally extended vanes, each vane of a set being fixed adjacent to an opposing end of said roller, and each vane having a tapered edge so that the side edges of said cotton module undergo compressive pressures in excess of that in a center portion of said cotton module.

20. The roller assembly of claim 17 wherein said roller is of a generally cylindrical shape.

21. The roller assembly of claim 17 further comprising an actuation means operatively coupled to said roller to provide rotational movement thereof about said axis.

22. The roller assembly of claim 21 wherein a speed of rotation of the roller is matched to a speed of movement of said carriage along a length of said one of said walls.

23. The roller assembly of claim 17 wherein said roller applies a continuous compressive pressure to said cotton module as said pressure member moves via said carriage along the length of said side wall.

24. The cotton module builder of claim 17 wherein said is a fluid actuated height adjustment ram.

25. The cotton module builder of claim 24 wherein said height adjustment ram is hydraulically actuated.

* * * * *